US009074449B1

(12) United States Patent
Lugo et al.

(10) Patent No.: US 9,074,449 B1
(45) Date of Patent: Jul. 7, 2015

(54) VERTICAL TREE PRODUCTION APPARATUS FOR USE WITH A TUBING HEAD SPOOL

(71) Applicants: Mario R. Lugo, Houston, TX (US); David Older, Houston, TX (US)

(72) Inventors: Mario R. Lugo, Houston, TX (US); David Older, Houston, TX (US)

(73) Assignee: TRENDSETTER ENGINEERING, INC., Houston, TX (US)

( * ) Notice: Subject to any disclaimer, the term of this patent is extended or adjusted under 35 U.S.C. 154(b) by 0 days.

(21) Appl. No.: 13/787,040

(22) Filed: Mar. 6, 2013

(51) Int. Cl.
*E21B 33/03* (2006.01)
*E21B 34/02* (2006.01)
*E21B 34/04* (2006.01)

(52) U.S. Cl.
CPC ..... *E21B 34/045* (2013.01); *E21B 33/03* (2013.01)

(58) Field of Classification Search
CPC ..... E21B 33/04; E21B 33/043
USPC ..... 166/348, 368
See application file for complete search history.

(56) References Cited

U.S. PATENT DOCUMENTS

| | | | | |
|---|---|---|---|---|
| 2,767,677 | A * | 10/1956 | Johnson et al. | 269/48.1 |
| 4,193,449 | A * | 3/1980 | Lochte et al. | 166/72 |
| 5,299,641 | A | 4/1994 | Paulo et al. | |
| 7,331,396 | B2 * | 2/2008 | Reimert et al. | 166/368 |
| 7,596,996 | B2 | 10/2009 | Zollo et al. | |
| 7,992,643 | B2 * | 8/2011 | Donald et al. | 166/339 |
| 2007/0034379 | A1 | 2/2007 | Fenton et al. | |
| 2009/0260829 | A1 | 10/2009 | Mathis | |
| 2011/0036562 | A1 | 2/2011 | Braekke | |

* cited by examiner

*Primary Examiner* — Matthew Buck
*Assistant Examiner* — Douglas S Wood
(74) *Attorney, Agent, or Firm* — Egbert Law Offices, PLLC

(57) ABSTRACT

A production apparatus for use with a subsea wellhead has a tubing head spool and a vertical tree. The tubing head spool has an end suitable for connection to the wellhead. The tubing head spool has a production bore extending therethrough and a tubing hanger arranged therein. The vertical tree has a tree connector at a lower end thereof. The vertical tree has flowline extending therethrough. The tree connector is affixed to a tubing head mandrel of the tubing head spool. The flowline is in valved communication with the production bore of the tubing head spool. The flowline extends outwardly of a vertical tree so as to allow a flow of production fluids outwardly of the vertical tree. The tubing head spool is a horizontal Christmas tree with master flow line and the annulus line sealed closed.

9 Claims, 2 Drawing Sheets

VERTICAL TREE PRODUCTION APPARATUS FOR USE WITH A TUBING HEAD SPOOL

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to apparatus and process for the production of well fluids. More particularly, the present invention the relates to vertical trees that can be used in association with a horizontal Christmas tree for the production of oil and gas. Additionally, the present invention relates to the modification of horizontal Christmas trees so as to be adaptable for the receipt of a vertical tree.

2. Description of Related an Including Information Disclosed Under 37 CFR 1.97 and 37 CFR 1.98.

In petroleum and natural gas extraction, a "Christmas tree" is an assembly of valves, spools, and fitting used for an oil and gas well. Christmas trees are used on both surface and subsea wells. An example of subsea Christmas trees include conventional, dual bore, mono bore, through flowline, horizontal, mud line, mud line horizontal, side valve, and through-bore trees. The deepest installed Christmas tree is in the Gulf of Mexico at approximately 9,000 feet.

The primary function of a tree is to control the flow, usually oil or gas, out of the well. The tree may also be used to control the injection of gas or water into a non-producing well in order to production rate of oil from other wells. When the well and facilities are ready to produce and receive oil or gas, tree valves are open and the formation fluids are allowed to go through a flow line. This leads to a processing facility, storage depot and/or other pipeline eventually leading to a refinery or distribution center. Flow lines on subsea wells usually lead to a fixed or floating production platform or to a storage ship or barge.

A tree often provides numerous additional functions including chemical injection points, well intervention means, pressure relief means, monitoring points (such as pressure, temperature, corrosion, erosion, sand detection, flow rate, flow composition, valve and choke position feedback), and connection points for devices such as downhole pressure and temperature transducers. On producing wells, chemicals or alcohols or oil distillates may be injected to preclude production problems (such as blockages).

Functionality may be extended further by using the control system on a subsea tree to monitor, measure, and react to sensor outputs on the tree or even down the well bore. The control system attached to the tree controls the downhole safety valve while the tree acts as an attachment and conduit means of the control system to the downhole safety valve.

Tree complexity has increased over the last few decades. They are frequently manufactured from blocks of steel containing multiple valves rather than being assembled from individual flanged components. This is especially true in subsea applications where the resemblance to Christmas trees no longer exists given the frame and support systems into which the main valve block is integrated.

The Christmas tree is installed on top of the wellhead. A wellhead is used without a Christmas tree during drilling operations, and also for riser tie-back situations that later would have a tree installed at riser top.

Subsea trees have a large variety of valve configurations and combinations of manual and/or actuated hydraulic or pneumatic valves. A typical tree will have at least four or five valves. There are a pair of lower valves are called the master valves. Master valves are normally in the fully open position and are never opened or closed when the well is flowing so as to prevent erosion of the valve sealing surfaces. An actuated wing valve is normally used to shut in the well when flowing, thus preserving the master valves for positive shutoff for maintenance purposes. Hydraulically-operated wing valves are usually built to be failsafe closed, meaning they require active hydraulic pressure to stay open. This feature means that if control fluids fail, the well will automatically shut itself in without operator action. A valve at the top is called the swab valve and lies in the path used for well interventions, such as wirelines. For such operation, a lubricator is rigged up onto the top of the tree and the wire or coil is lowered through the lubricator, past the swab valve and into the well. Some trees have a second swab valve in which the valves are arranged one on top of the other.

Subsea trees are available in either vertical or horizontal configurations. Typically, a subsea tree would have a choke (permitting the control of flow), a flow line connection interface (such as a hub, a flange or other connection), a subsea control interface (direct hydraulic, electro hydraulic, or electric) and sensors for gathering data such as pressure, temperature, sand flow, erosion, multiphase flow, and single phase flow.

One type of Christmas tree has a pair of bores extending through it. One of bores is the production bore and the other is a tubing annulus access bore. In this type of wellhead assembly, the tubing hanger lands in the wellhead housing. The tubing hanger has two passages through it. One passage is the production passage and the other passage is an annulus passage that communicates with the tubing annulus surrounding the tubing. Access to the tubing annulus is necessary to circulate fluids down the production tubing and up through the tubing annulus, or vice versa, to either kill the well or circulate out heavy fluid during completion.

After the tubing hanger is installed and before the drilling riser is removed for installation of the tree, plugs are temporarily placed in the passages of the tubing hanger. The tree has isolation tubes that stab into engagement with the passages in the tubing hanger when the tree lands on the wellhead housing. This type of tree is normally run on a completion riser that has two strings of conduit. In a dual string completion riser, one string extends from the production passage of the tree to the surface vessel, while the other extends from the tubing annulus passage in the tree to the surface vessel.

Unfortunately, the need for the production of oil and gas has created shortages in the availability of such Christmas trees. Often, the well cannot be completed until such time as the Christmas tree is available. In certain circumstances, the Christmas trees may not be available for several years. In order to accommodate this problem, it is necessary for drillers to partially drill the well and then plug the well or cement the well so as to block the release of hydrocarbons from the well. The drilling rig can then be moved to another location.

Ultimately, when the Christmas tree is available for installation on the wellhead, the driller will move the drilling rig back to the location of the original hole, remove the plug, and begin to complete the drilling of the well. After the well is completed, the Christmas tree can be installed using the drilling risers.

Presently, the drilling rig can cost approximately one million dollars per day. As such, there is a great deal of waste of time and money during the time in which the Christmas tree is not available. The driller must rent the drilling rig in order to partially complete the well, wait for the Christmas tree, and then recall the drilling rig so as to complete the production process. Under certain circumstances, the driller may actually have the Christmas tree available, but must wait for the drilling rig to be available for the completion of the well. Ultimately, after the well is completed, the Christmas tree can be installed as needed.

Used horizontal Christmas trees are readily available. However, the refurbishment of such used horizontal Christmas trees is a very complex, time consuming and expensive tasks. Ultimately, the cost of refurbishing a used horizontal Christmas tree can be nearly equal to the cost associated with a new Christmas tree. During refurbishment, the wide variety of valves and controls must be completely modified so as to avoid problems associated with corrosion and erosion. Unless extensive modifications are made to these used Christmas trees, there can be a wide variety of leak paths which can occur if the used Christmas tree is utilized without refurbishment. As such, typically, refurbishment of horizontal Christmas tree is not an attractive alternative to producers.

In the past, various patents have issued relating to such Christmas trees and the plugs associated therewith. For example, U.S. Pat. No. 5,299,641, issued on Apr. 5, 1994 to Paulo et al., describes a Christmas tree for subsea production. The Christmas tree has a connector at a bottom thereof for the purposes of locking to the wellhead. A guide structure is provided having a central ring attached to the connector.

U.S. Pat. No. 7,596,996, issued on Oct. 6, 2009 to Zollo et al., provides a Christmas tree with an internally positioned flowmeter. This is a measurement device that has structure adapted to be removably coupled to the Christmas tree. A sleeve is operatively coupled to the structure. The flowmeter is positioned at least partially within the sleeve.

U.S. Patent Publication No. 2007/0034379, published on Feb. 15, 2007 to Fenton et al., provides a plug installation for deep water subsea wells. A plug retrieval and installation tool is used with a subsea well having a production tree, a tubing hanger, a passage that extends vertically through the tubing hanger, and the tree. A plug is located within a plug profile in the passage within the tubing hanger. The plug retrieval device has a housing and connector that is lowered on a lift line onto the upper end of the tree. An axially extendible stem in the housing is moved with hydraulic fluid controlled by an ROV into the production passage of the tubing hanger. An installation and retrieval member mounted to the stem engages the plug and pulls it upwardly in the passage while the stem is being moved upwardly and pushes the plug downward to install the plug while the stem is being moved downward.

U.S. Patent Publication No. 2009/0260829, published on Oct. 22, 2009 to D. J. Mathis, provides a subsea tree safety control system for limiting the probability of failure on demand of the tree. This subsea shut-in system serves to actuate a safety valve on the tree. The safety shut-in system includes a surface control station positioned above a water surface connected via an umbilical to a subsea control system positioned below the water surface to actuate the safety valve. The safety-in system is diagnostically tested without actuating the safety valve.

U.S. Patent Publication No. 20110036562, published on Feb. 17, 2011 to K. Braekke, discloses a well plug having a flexible expandable sealing and a metallic anchor that can be moved radially out or in by rotating a leadscrew in opposite directions. The well plug has a ball valve in a central longitudinal passage which is kept open whenever the leadscrew rotates. This increases the accuracy when setting the plug and reduces the risk of the plug moving uncontrolled in the well bore during setting or retrieval. The ball valve can be opened or closed by rotating a transmitting shaft within an angle of free motion before the leadscrew is pulled along in the rotation.

It is an object of the present invention to provide a production system wherein a vertical tree can be secured to a modified horizontal Christmas tree.

It is another object of the present invention to provide a production system that is able to effectively use used horizontal Christmas trees.

It is still another object of the present invention to provide a production system whereby used Christmas trees can be easily modified for use in conjunction with a vertical tree so as to be ready for use.

It is still another object of the present invention to provide a production system which effectively couples a vertical Christmas tree to a horizontal Christmas tree.

It is still another object of the present invention to provide a productions system whereby production can be expedited from an existing well.

These and other objects and advantages of the present invention will become apparent from a reading of the attached specification and appended claims.

BRIEF SUMMARY OF THE INVENTION

The present invention is a production system for use with a subsea wellhead. This production system has a tubing head spool that has an end suitable for connection to the wellhead and a vertical tree that is suitable for connection to the tubing head spool. The tubing head spool has a production bore extending therethrough. The production bore has a tubing hanger arranged therein. The tubing hanger is suitable for securing a pipe therein. The tubing head spool has a tubing head mandrel at an upper end thereof. The vertical tree has a tree connector at a lower end thereof. The vertical tree has a flowline extending therethrough. The tree connector is affixed to the tubing head mandrel of the tubing head spool. The flowline is in valved fluid communication with the production bore of the tubing head spool. The flowline extends outwardly of the vertical tree so as to allow a flow of production fluids outwardly of the vertical tree.

The tubing head spool has an annulus formed around the production bore. The vertical tree has an annulus flowline in communication with the annulus of the tubing head spool. The annulus flowline extends outwardly of the vertical tree. The tubing head spool has a valve block formed thereon. This valve block has a master flowline in communication with the production bore. The master flowline extends outwardly of a side of the tubing head spool. The master flowline is a sealed closed. The tubing head spool also has an annulus line extending outwardly of a side of the tubing head spool. The annulus line is in communication with the annulus of the tubing head spool. The annulus line is also sealed closed. The tubing head spool further has a control mechanism cooperative with the tubing hanger. The control mechanism has function control actuators extending outwardly of a side of the tubing head spool such that an ROV, or other mechanism, can manipulate the functions of the tubing hanger mechanism.

Within the concept of the present invention, tubing head spool is a modified horizontal Christmas tree. In other words, a used horizontal Christmas tree has a various components that are removed therefrom so as to facilitate the use in the present application. In particular, the master flow line and the annulus line are sealed closed so as to avoid any possible leak pathways.

The vertical tree has a workover mandrel at an upper end thereof. This workover mandrel is suitable for connection to a blowout precentor. The flowline of the vertical tree extends outwardly of a side of the vertical tree so as to allow production fluids from the production bore to flow outwardly of the vertical tree. The vertical tree has a tree valve block formed above the tree connector. The tree valve block has valves therein suitable for controlling a flow of fluid in the flowline and in the annulus flowline.

The present invention is also a method of converting a horizontal Christmas tree into a tubing head spool. The horizontal Christmas tree is of a type having a production bore and an annulus. The horizontal Christmas tree will have a tubing hanger arranged within the annulus within the production bore. The horizontal Christmas tree has a master flowline extending outwardly of a side of the horizontal Christmas tree and an annulus line also extending outwardly of a side of the horizontal Christmas tree. The method comprises the steps of: (1) permanently sealing the master flowline closed; and (2) permanently sealing the annulus line closed. In particular, the step of permanently sealing the master flowline includes welding a flange over an outlet of the master flowline. The step of permanently sealing the annulus line includes affixing a cover over an outlet of the annulus line.

The present invention is also a vertical tree for use with a horizontal Christmas tree. This vertical tree comprises a body having a tree connector at a lower end thereof and a tree valve block formed above the tree connector, a flowline extending through the body and having an end at the tree connector and an opposite end extending outwardly of a side of the tree valve block, and an annulus flowline line having an end at the tree connector and an opposite end extend outwardly of an side of the tree valve block.

The tree connector is affixed onto the tubing head mandrel of the horizontal Christmas tree such that the flowline is in valved fluid communication with a production bore of the horizontal Christmas tree and such that such annulus flowline is in valved fluid communication with an annulus of the horizontal Christmas tree.

The body has a junction block on the side thereof. The flowline has a valve cooperative therewith. The annulus flowline also has a valve cooperative therewith. The junction plate supports the actuators that are cooperative with the valves of the flowline and with the annulus flowline. The flowline has a production master valve and a production swab valve cooperative therewith. The production mater valve is suitable for controlling flow of a production fluid outwardly of the body. The annulus flowline has an annulus master valve and the annulus swab valve cooperative therewith. The annulus master valve is suitable for allowing annulus pressures to be monitored and released. A chemical injection line extends through the tree valve block and is in valved communication with the flowline. This chemical injection line is suitable for allowing chemicals to be injected into the flowline. A workover mandrel is affixed to the tree valve block at an end opposite the tree connector. The workover mandrel has a flow passageway extending therethrough. The flow passageway is in valved communication with the flowline. The workover mandrel is suitable for allowing an blowout preventer to be positioned thereon.

This foregoing section is intended to describe, in generality, the preferred embodiment of the present invention. It is understood that modifications to this preferred embodiment can be made within the scope of the present invention. As such, this section should not to be construed, in any way, as limiting of the broad scope of the present invention. The present invention should only be limited by the following claims and their legal equivalents.

DETAILED DESCRIPTION OF THE INVENTION

Figure 1:
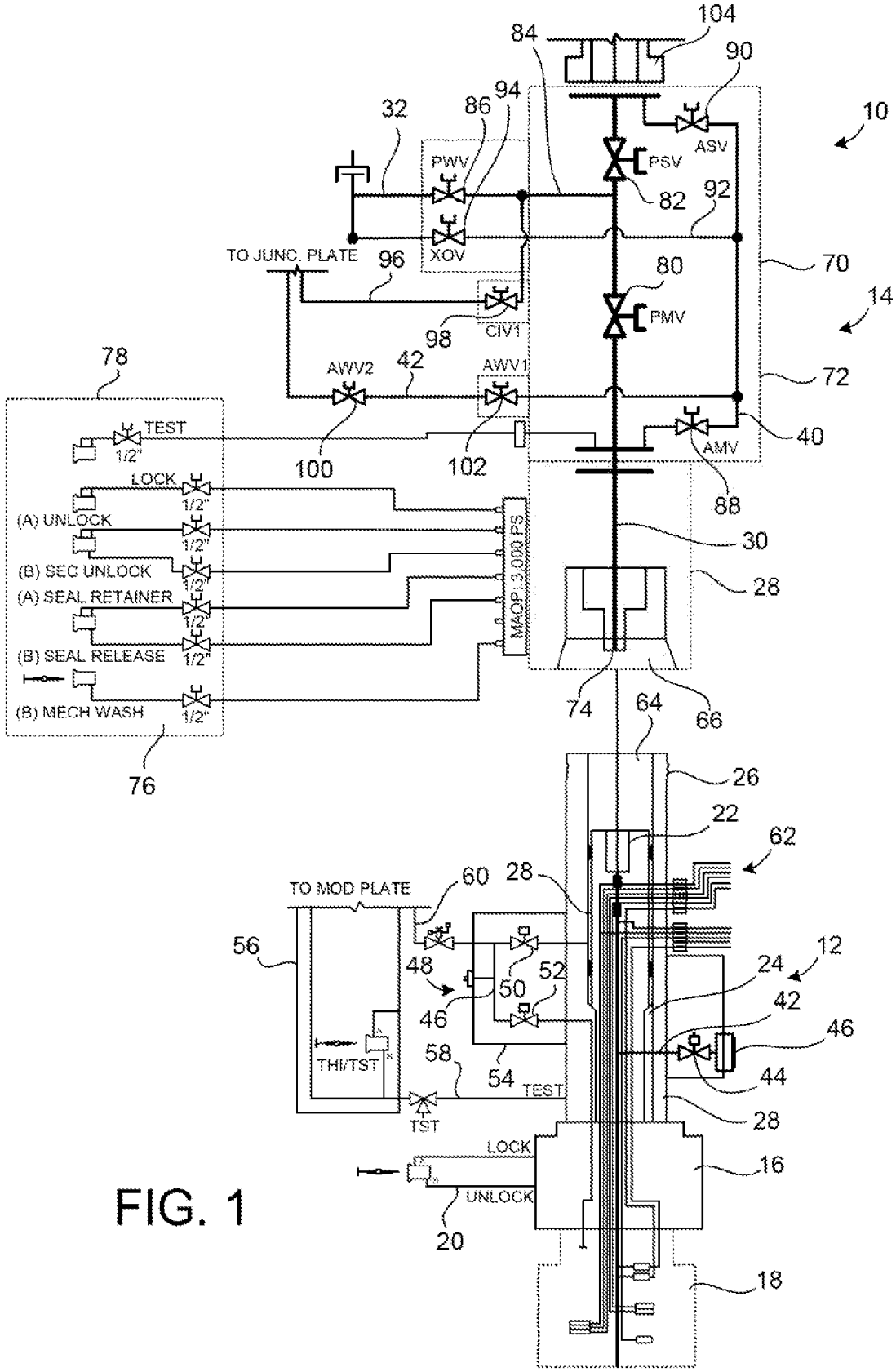
FIG. 1 is an exploded and diagrammatic illustration of the production system in accordance with the preferred embodiment of the present invention.

Referring to FIG. 1, there is shown the production system 10 in accordance with the preferred embodiment of the present invention. The production system 10 includes a tubing head spool 12 and a vertical tree 14. The tubing head spool 12 has a tubing head connector 16 at a lower end thereof. The tubing head connector 16 is suitable for attachment to the wellhead 18. A suitable control mechanism 20 is connected to the tubing head connector 16 so as to control the locking or unlocking of the tubing head connector 16 onto the wellhead 18. The tubing head spool 12 has a production bore 22 extending therethrough. The production bore 22 includes a tubing hanger 24 arranged therein. The tubing hanger 24 is suitable for securing a pipe within the production bore 22. A tubing head mandrel 26 extends outwardly of an upper end of the valve block 28 of the tubing head spool 12.

The vertical tree 14 has a tree connector 28 at a lower end thereof. The tree connector 28 is suitable for joining to the tubing head mandrel 26 of the tubing head spool 12. The vertical tree 14 has a flowline 30 extending therethrough. The flowline 30 will be in valved fluid communication with the production bore 22 of the tubing head spool 12. The flowline 30 will extend outwardly along line 32 of the vertical tree 14 so as to allow a flow of production fluids outwardly of the vertical tree 14.

As can be seen in FIG. 1, the tubing head spool 12 has an annulus 38 formed around the production bore 22. The vertical tree 14 will also have an annulus flowline 40 in valved communication with the annulus 38 with the tubing head spool 12. The annulus flowline 40 will include a suitable line 42 which extends outwardly of the vertical tree 14.

As can be seen in FIG. 1, a master flowline 42 is connected to the production bore 22 of the tubing head spool 12. The master flowline 42 has a valve 44 positioned thereon. Within the concept of the present invention, the master flowline 42 will have an outlet that is sealed by a plate 46. Plate 46 can be welded onto the outlet of the master flowline 42 so as to prevent any leakage of fluids therethrough. As such, an existing horizontal Christmas tree can be suitably modified so as to seal closed the master flowline. The various other appliances associated with the horizontal Christmas tree can be removed therefrom so as to minimize the number components associated with the tubing head spool 12.

An annulus line 46 is connected to the annulus 38 of the tubing head spool 12. The annulus line 46 is found on conventional horizontal Christmas trees. In the present invention, the outlet of the annulus line 46 is closed by affixing a cover 48 thereover. Cover 48 can be affixed over the outlet of the annulus line 46 by welding, bolting, or by other means of attachment. As such, leakage through the annulus line 46 is prevented. The annulus line 46 would include valves 50 and 52 which are covered by an annulus wing block 54. The junction plate 56 is provided on the tubing head spool 12. Suitable controls are provided on the multiple quick-connect junction plate 56 so as to allow for the control of the tubing hanger 24. As such, the tubing hanger 24 can be operated in the manner of a conventional tubing hanger 24 associated with at horizontal Christmas tree. A test line 58 and a control line 60 are provided and maintained relative to the tubing hanger 24 so as to control the functions of the tubing hanger 24. In this construction, the horizontal Christmas tree is not modified in relation to the operation of the tubing hanger 24. As such, the existing tubing hanger functions associated with a convention horizontal Christmas tree are maintained. A variety of control lines 62 extend into the tubing head spool 12 so as to control various functions associated with the control valve lines.

The tubing head mandrel 26 opens at a top of the tubing head spool 12. The tubing head mandrel 26 includes suitable connection elements that will allow for the secure connection of the tree connector 28 of the vertical tree 14. A receptacle 64 is formed on the interior of the tubing head mandrel 26 so as to receive the flowline 30 of the vertical tree 14 therein. As a result, the opening 64 at the bottom of the tree connector 28 of the vertical tree 14 can be properly stabbed upon the tubing head mandrel 26 so as to secure the flowline 30 to the production bore 22 of the tubing head spool 12.

The vertical tree 14 has a body 70 with the tree connector 28 at a lower end thereof and a tree valve block 72 formed above the tree connector 28. The flowline 30 extends through the body 70 so as to have an end 74 at the opening 66 of the tree connector 28. The flowline 30 has an opposite end that extends outwardly of a side of the tree valve block 72.

Various control mechanisms 76 are received within a junction plate 78 and in association with the tree connector 28. These various control mechanisms 76 serve to effectively lock the tree connector 28 upon the tubing head mandrel 26. For example, these control mechanisms can include a test mechanism, a lock/unlock mechanism, a seal retainer mechanism, a seal release mechanism, and a methane wash. Each of these lines are respectively hydraulically connected to the tree connector 28 and cooperative with mechanisms therein so as to establish a proper sealing relationship between the tubing head spool 12 and the vertical tree 14.

The flowline 30 is illustrated as being in flanged connection between the tree connector 28 and tree valve block 72. The flowline 30 extends to a production master valve 80 and to a production swab valve 82. Ultimately, the flowline 30 will extend along line 84 outwardly of the body 70. A production wing valve 86 is cooperative with the line 80. As such, the flow of production fluids will pass through the flowline 30 and outwardly through line 84 to a collection location. The annulus flowline 40 is in valved communication with the annulus 38 of the tubing head spool 12. An annulus master valve 88 is cooperative with the annulus line 46 so as to control the flow of fluids therethrough. Ultimately, the annulus master valve 88 will allow for the annulus pressure to be monitored and released. An annulus swab valve 90 is also cooperative with the annulus flowline 40. Another line 92 extends from the annulus flowline 40 and outwardly of a side of the body 70 of the vertical tree 14. A cross-over valve 94 is positioned along line 92.

In the present invention, there is a chemical injection line 96 that is connected to the line 84 associated with the flowline 30. The chemical injection line 96 allows chemicals to be introduced into the flowline 30 and into the production bore 22. As such, any methane formations can be addressed through chemical injection. A chemical injection valve 98 is provided along the chemical injection line 96 so as to control the flow of the chemical injection into the flowline 30. Annulus wing valves 100 and 102 are provided along the line 42 associated with the annulus flowline 40.

A workover mandrel 104 is positioned at an end of the body 70 opposite the tree connector 28. The workover mandrel 104 is suitable for connection to a blowout preventer, as required. The workover mandrel 104 can have a flow passageway therein that is in valved communication with the flowline 30. As such, if it is necessary to introduce tools into the flowline 30 and/or into the production bore 22, the workover mandrel 104 (in combination with the blowout preventer) can allow such tools to be proper introduced into the interior of the components. As such, various tools can be inserted so as to remove any plugs that may be installed into the production bore 22 of the tubing head spool 12 so as to allow for the assembly of the present invention.

Figure 2:
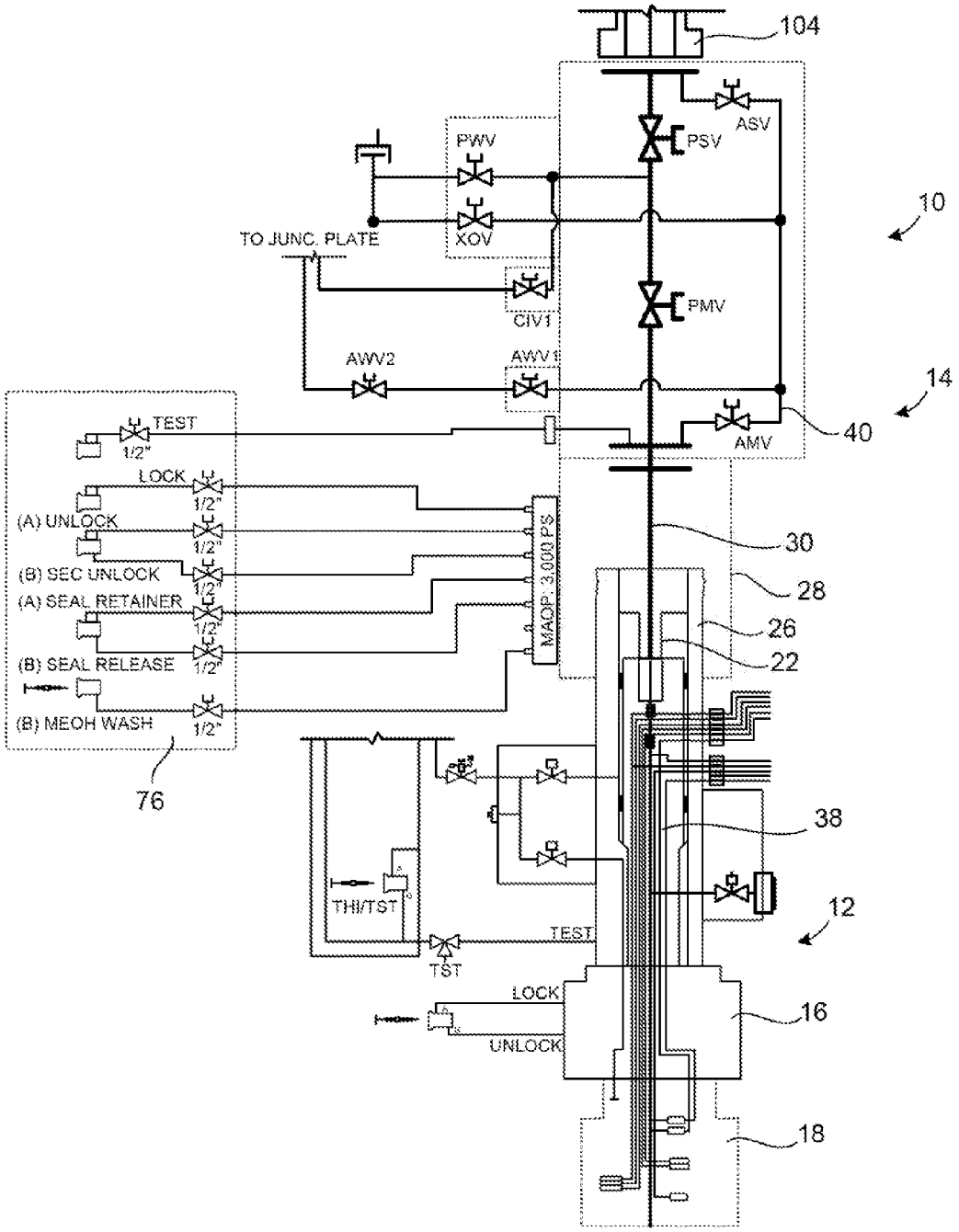
FIG. 2 is a diagrammatic assembled view of the production system in accordance with the preferred embodiment of the present invention.

FIG. 2 shows the assembly of the tubing head spool 12 with the vertical tree 14. As can be seen, the tree connector 28 receives the tubing head mandrel 26 therein. The operation of the control mechanisms 76 allows a proper sealing relationship to be established between the exterior surfaces of the tubing head mandrel 26 and the interior surfaces of the tree connector 28. Additionally, a proper sealing relationship can be established between the flowline 30 and the production bore 22. As a result, proper fluid communication is established between the flowline 30 and the production bore 22. Additionally, a proper connection is also established between the annulus flowline 40 and the annulus 38 of the tubing head spool 12.

In the installation of the production system 10 of the present invention, the suitable plugs are positioned within the production bore 22 of the tubing head spool 12. Initially, a blowout preventer can be placed upon the tubing head mandrel 26. The blowout preventer, along with the tubing head spool 12, can be landed upon the wellhead 18 in a conventional manner. In particular, the tubing head connector 16 will be placed over the wellhead 18. As such, the tubing head spool 12, along with its connected blowout preventer, will be arranged over the wellhead 18. Once it is established that a proper sealing relationship is established between the tubing head connector 16 and the wellhead 18, the blowout preventer can be removed. The vertical tree 14 can then be placed over the tubing head spool 12 such that the tubing head mandrel 26 is received within the interior of the tree connector 28. A blowout preventer can then be placed over the workover mandrel 104. Since the production bore 22 of the tubing head spool 12 is sealed through the use of plugs, it can be assured that there will be no leakage that occurs through the vertical tree 14. A blowout preventer can then be placed onto the workover mandrel 104.

Once a proper sealing relationship is established between the vertical tree 14 and the tubing head spool 12, a wire line can be placed through the interior of the blowout precentor, through the workover mandrel 104, and through the flowline 30. The wire line can include a suitable mechanism for releasing the plugs within the production bore 22 of the tubing head spool 12. Once the plugs are removed, the production fluids will flow through the production bore 22 and into the flowline 30. Once the plugs are removed, and a proper flowing relationship is established between the production fluids and the flowline 30, the blowout preventer can be removed from the workover mandrel 104. The workover mandrel 104 can be properly sealed so as to prevent the release of any fluids therethrough.

The present invention achieves significant advantages over the prior art. In particular, in the present invention, the tubing head spool 12 will be in the nature of a conventional horizontal Christmas tree. However, rather than refurbish a used horizontal Christmas tree, the various worn components of such horizontal Christmas tree are removed so as to form the tubing head spool 12. The complex mechanisms associated with the tubing hanger are maintained within the tubing head spool 12. It is only necessary to refurbish those components associated with the tubing hanger. Ultimately, the production flowline and the annulus line of the tubing head spool are sealed so as to prevent any leakage therefrom. The existing horizontal Christmas tree has all of the pressure gauges, monitors, and assorted other controls removed therefrom. As such, the complex refurbishment of such controls, gauges and sensors are not necessary within the concept of the present invention. The present invention utilizes the vertical tree 14 so as to carry out the functions associated with the horizontal Christmas. As such, by connecting the vertical tree 14 to the tubing head spool 12, the present invention will carry out all of the functions of a horizontal Christmas tree without the expense or complexity associated therewith. As a result, existing and used horizontal Christmas trees can be made readily available for use in production.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

We claim:

1. A production apparatus for use with a subsea wellhead comprising:

a tubing head spool having an end suitable for connection to the wellhead, said tubing head spool having a production bore extending therethrough, said production bore having a tubing hanger arranged therein, said tubing hanger suitable for securing a pipe therein, said tubing head spool having a tubing head mandrel at an upper end thereof, said tubing head spool having a valve block formed thereon, said valve block having a master flowline in communication with said production bore, said master flowline extending outwardly of a side of said tubing head spool, said master flowline being permanently sealed closed, said tubing head spool having an annulus formed around said production bore, a vertical tree having an annulus flowline in communication with said annulus of said tubing head spool, said annulus flowline being permanently sealed closed, said tubing head spool being a previously-used horizontal Christmas tree; and said vertical tree having a tree connector at a lower end thereof, said vertical tree having a flowline extending therethrough, said tree connector affixed to said tubing head mandrel of said tubing head spool, said flowline being in valved fluid communication with said production bore of said tubing head spool, said flowline extending outwardly of said vertical tree so as to allow a flow of production fluids outwardly of said vertical tree.

2. The production apparatus of claim 1, said annulus flowline extending outwardly of said vertical tree.

3. The production apparatus of claim 1, said tubing head spool having a control mechanism cooperative with said tubing hanger, said control mechanism having function control actuators extending outwardly of a side of said tubing head spool.

4. The production apparatus of claim 1, said vertical tree having a workover mandrel at an upper end thereof, said workover mandrel suitable for connection to a blowout preventer.

5. The production apparatus of claim 1, said flowline of said vertical tree extending outwardly of a side of said vertical tree so as to allow production fluids from said production bore to flow outwardly of said vertical tree.

6. The production apparatus of claim 1, said vertical tree having a tree valve block formed above said tree connector, said tree valve block having valves therein suitable for controlling a flow of fluid in said flowline and in said annulus flowline.

7. A method of converting a previously-used horizontal Christmas tree into a tubing head spool, the horizontal Christmas tree having a production bore and an annulus, said horizontal Christmas tree having a tubing hanger arranged in said annulus, said horizontal Christmas tree having a master flowline extending outwardly of a side of said horizontal Christmas tree and an annulus line extending outwardly of the side of said horizontal Christmas tree, the method comprising:

permanently sealing said master flowline closed; and permanently sealing said annulus line closed.

8. The method of claim 7, said step of permanently sealing the master flowline comprising:

welding a flange over an outlet of said master flowline.

9. The method of claim 7, the step of permanently sealing the annulus line comprising:

affixing a cover over an outlet of said annulus line.

* * * * *